US007493970B1

(12) United States Patent
McKnight, Jr. et al.

(10) Patent No.: US 7,493,970 B1
(45) Date of Patent: Feb. 24, 2009

(54) SHOCK MOUNTED TOP DRIVE

(75) Inventors: Thomas Nelson McKnight, Jr., 1113 Dayton Rd., Midland, TX (US) 79706; Sammy Kent Flud, Midland, TX (US); Jerald Craig Briske, Anchorage, AK (US)

(73) Assignee: Thomas Nelson McKnight, Jr., Austin, TX (US)

( * ) Notice: Subject to any disclaimer, the term of this patent is extended or adjusted under 35 U.S.C. 154(b) by 0 days.

(21) Appl. No.: 11/946,727

(22) Filed: Nov. 28, 2007

(51) Int. Cl.
*E21B 3/02* (2006.01)

(52) U.S. Cl. ..... 175/113; 175/170; 175/162

(58) Field of Classification Search ..... 175/113, 175/170, 172, 195, 162, 220; 166/85.1, 78.1; 254/393, 403
See application file for complete search history.

(56) References Cited

U.S. PATENT DOCUMENTS 3,994,350 A 11/1976 Smith et al.
4,300,276 A 11/1981 Davis
4,589,503 A * 5/1986 Johnson et al. ..... 175/113
7,178,788 B1 * 2/2007 Flud et al. ..... 254/337
2006/0231267 A1 * 10/2006 Wood ..... 166/379

* cited by examiner

*Primary Examiner*—David J Bagnell
*Assistant Examiner*—David Andrews
(74) *Attorney, Agent, or Firm*—Buskop Law Group, PC; Wendy Buskop

(57) ABSTRACT

A shock mounted top drive comprising a traveling frame for moving along a drilling tower, the traveling frame comprising a first and second housing section, at least one set of sheaves mounted to the upper section of each housing section, a guide wheel assembly secured to the outboard side of each housing section, at least one swivel support disposed on the inboard side of each housing section, at least one shock absorber disposed on each swivel support, and at least one upper stop connected to the inboard side of each housing section. A top drive power swivel, which has a housing and a rotating drive shaft, is secured to the traveling frame using a plurality of removable top drive retainers. The top drive retainers engage the inboard side of each housing section between the upper stops and the shock absorbers.

14 Claims, 6 Drawing Sheets

SHOCK MOUNTED TOP DRIVE

FIELD

The present embodiments relate to a shock mounted top drive for well drilling rigs.

BACKGROUND

A need exists for a top drive for a drilling rig that is shock mounted and capable of fast installation, removal, and replacement.

A further need exists for that permits movement along a tubular or rail of a drilling tower that is effectively and safely restricted using one or more stops and shock absorbers.

The present embodiments meet these needs.

BRIEF DESCRIPTION OF THE DRAWINGS

The detailed description will be better understood in conjunction with the accompanying drawings as follows.

Figure 1:
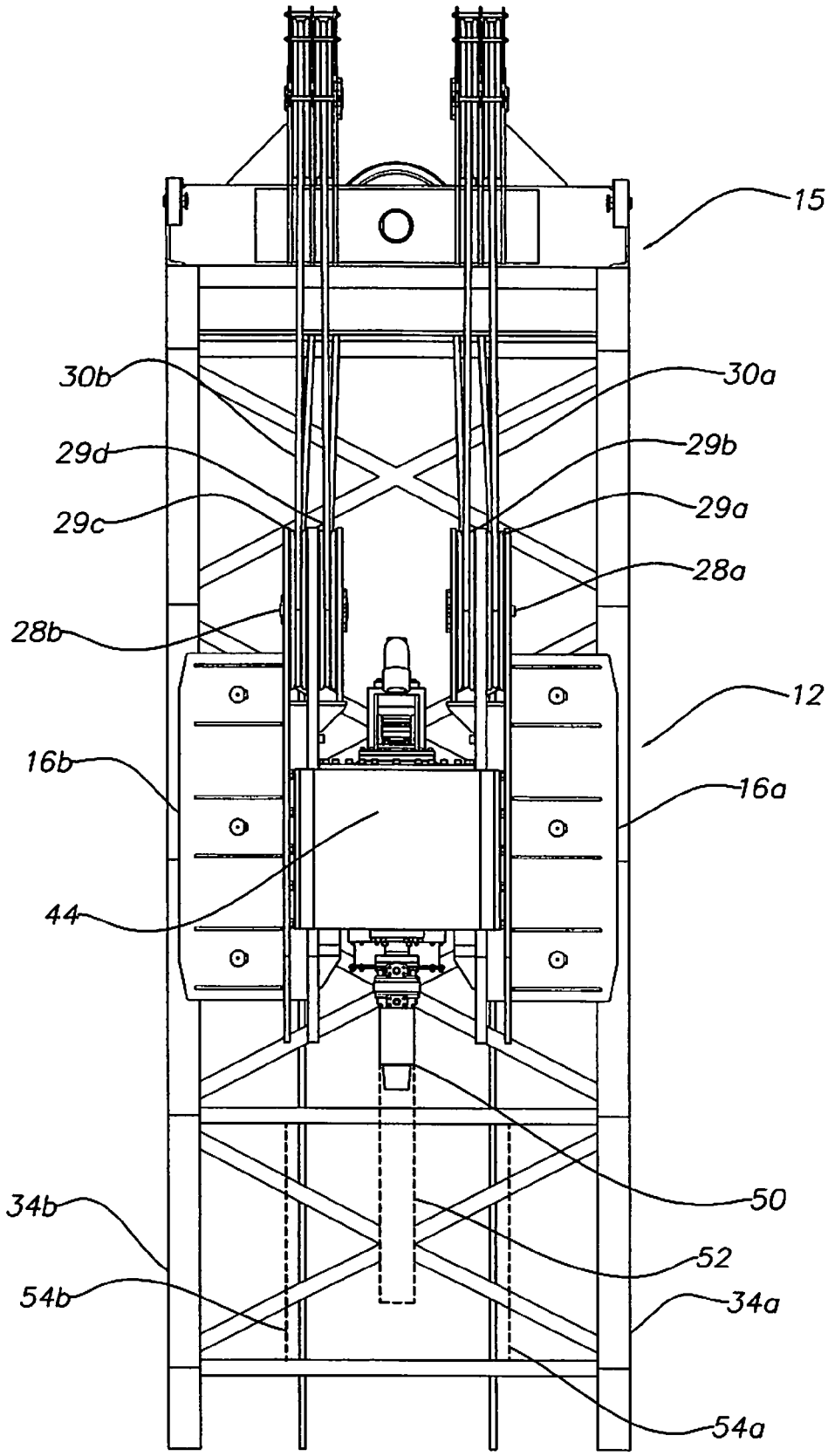
FIG. 1 is a side view of an embodiment of the present shock mounted top drive engaging a drilling tower.

The present embodiments are detailed below with reference to the listed Figures.

DETAILED DESCRIPTION OF THE EMBODIMENTS

Before explaining the present apparatus in detail, it is to be understood that the apparatus is not limited to the particular embodiments and that it can be practiced or carried out in various ways.

The present embodiments relate to a shock mounted top drive for well drilling rigs.

The present shock mounted top drive can be removable from a drilling rig, enabling the assembly to be installed, or removed for repairs or replacement, quickly and efficiently.

The present shock mounted top drive can further include a removable top drive power swivel, which can be removed from a traveling frame for efficient repairs or replacement, faster and more economical transportation, and more efficient assembly and installation.

The present shock mounted top drive also advantageously provides a range of vertical movement, such as 12 inches, along a tubular or rail of a drilling rig, while preventing uncontrolled movement through use of stops and shock absorbers.

The shock mounted top drive can have a traveling frame.

The traveling frame can engage a drilling tower on a well drilling rig. The drilling tower can be contemplated to have at least one tubular on one side of the well drilling rig, and at least a second tubular on an opposite side of the well drilling rig. The tubulars are generally contemplated to be maintained substantially parallel to each other.

In an embodiment, the traveling frame can engage a set of substantially parallel rails secured to the tubulars.

In an embodiment, the tower can be a derrick.

The traveling frame can have two housing sections: a first housing section and a second housing section. Each housing section can be substantially parallel and positioned on opposite sides of the traveling frame.

Each housing section can have an upper section, a lower section with a lower section housing extension, an inboard side, and an outboard side.

Each housing section can also be connected to at least one set of sheaves. The sets of sheaves, which can include one, two, or three sheaves per set, can be mounted to each upper section. Each set of sheaves is adapted to engage a hoisting means, which can be a cable or a wire rope connected to additional hoisting means, such as blocks, a crown, an accumulator, and other equipment.

A guide wheel assembly can be secured to each outboard side of each housing section. Each guide wheel assembly can engage a tubular or rail on the drilling tower.

An embodiment contemplates that each guide wheel assembly can have at least one guide wheel disposed between at least two wear pads. Use of three or more guide wheels per guide wheel assembly can also contemplated.

At least one swivel support can be secured to each inboard side of each lower section.

The swivel supports can have a thickness from about 0.5 inches to about 3 inches, and can be as long as the power swivel is wide.

The swivel supports can provide a foundation for at least one shock absorber. Although a first shock absorber is contemplated for use herein, it can be possible that two layers of shock absorbers can be used on one swivel support. Multiple layers of different materials can be used to form the shock absorbers. Alternatively, a homogenous layer of one material can be used as the shock absorbers.

The shock absorbers can be made from a compressible material that absorbs energy. Examples of such materials can include a steel alloy, a rubber, a synthetic rubber, an elastomer, a polyamide, or combinations thereof.

The swivel supports can be made from steel or coated iron, such as iron coated with an elastomeric coating, or paint which resists corrosion.

At least one upper stop can be connected to each inboard side of each upper section. The upper stops can be made from a non deformable stiff metal capable of resisting deformation upon impact. A tough plastic or an alloy of steel can be used. The upper stops can include one continuous bar extending the width of the power swivel, or the upper stops can include multiple bars, such as two or more metal bars in a spaced apart relation, connected to the traveling frame. The upper stops can also incorporate a shock absorber.

A top drive power swivel engages the traveling frame. The top drive power swivel can have a power swivel housing. The power swivel housing can have a first traveling frame side that engages the first housing section of the traveling frame opposite a second traveling frame side, which engages the second housing section of the traveling frame.

The top drive power swivel can further have a rotating drive shaft, rotatable on an axis that is parallel to a hoisting axis for the hoisting means. Each set of sheaves forms a hoisting axis when attached to the hoisting means. The hoisting axes are substantially parallel with the rotating drive shaft axis.

In an embodiment, the rotating drive shaft can rotate between about 0 revolutions per minute to about 180 revolutions per minute.

The top drive power swivel can receive power from one or more hydraulic or electric motors, which can be disposed on the power swivel housing.

A plurality of top drive retainers, each of which can be a bar-shaped construction or a plurality of parallel bars, are connected to the power swivel housing, enabling the top drive power swivel to removably and quickly engage each section of the traveling frame.

The top drive retainers engage the inboard sides of each traveling frame section between the upper stop and the shock absorber. In an embodiment, the top drive power swivel has some vertical motion between each upper stop and shock absorber, up to 12 inches of vertical movement. In another embodiment, the movement is very slight, enabling the top drive power swivel to press into the shock absorber for more controlled motion of the top drive power swivel.

The top drive retainers are, in an embodiment, contemplated to be a generally rectangular bar of stiff, non-deformable material, having a width ranging from three inches to nine inches and a length that generally is the length of the power swivel housing. Each top drive retainer can include a plurality of fasteners, such as ten fasteners, for securing to the traveling frame. In an embodiment, each top drive retainer can be secured to the traveling frame by welding.

The top drive power swivel is removably secured to the traveling frame, enabling replacement of the top drive power swivel in the field in less than one hour.

Referring now to FIG. 1, a side view of an embodiment of the present shock mounted top drive engaging a drilling tower is shown.

A drilling tower (15), which can be a derrick or another type of drilling tower, is shown having a first tubular (34*a*) substantially parallel to a second tubular (34*b*). The tubulars can be of any size, such as having a diameter of six inches, and the tubulars can be spaced apart by a distance, such as ten to sixteen feet.

A traveling frame (12) is shown engaging the drilling tower (15) for moving vertically along the legs of the drilling tower (15). The traveling frame (12) includes a first housing section (16*a*), and a second housing section (16*b*) substantially parallel to the first housing section (16*a*). In this depicted embodiment, the first and second housing sections are identical to each other in size and shape.

A power swivel housing (44) is disposed between the first housing section (16*a*) and the second housing section (16*b*). The dimensions of the first housing section (16*a*), the second housing section (16*b*), and the power swivel housing (44) can vary depending on the size of the drilling tower (15) and the diameter of the tubulars (34*a* and 34*b*).

Each housing section (16*a* and 16*b*) and the power swivel housing (44) can be made from a stiff metal, such as coated steel. The traveling frame (12) can range in overall size from about 72 inches to about 96 inches in length, from about 72 inches to about 96 inches in width, and from about 84 inches to about 120 inches in height. Each housing section (16*a* and 16*b*) and the power swivel housing (44) can be coated, such as with paint or a corrosion-resistant coating.

A first set of sheaves (28*a*) is secured to the first housing section (16*a*), and a second set of sheaves (28*b*) is secured to the second housing section (16*b*). Each set of sheaves is depicted having two individual sheaves (29*a*, 29*b*, 29*c*, and 29*d*), however it is contemplated that a single sheave can be used in a set of sheaves. Three or more sheaves can also be used in a set of shaves.

A first hoisting means (30*a*) is secured to the first set of sheaves (28*a*), and a second hoisting means (30*b*) is secured to the second set of sheaves (28*b*). In an embodiment, each hoisting means can be any type of wire, cord, or cable, such as a coated metal cord with a diameter of about 2 inches. The diameter of each hoisting means can be varied to fit within the sheaves used.

The first hoisting means (30*a*) and the second hoisting means (30*b*) are used to vertically move the traveling frame (12) along each of the tubulars (34*a* and 34*b*), and to maintain the position of the traveling frame (12) along the drilling tower (15) when movement is not desired.

A rotating drive shaft (50) is secured through the power swivel housing (44). The rotating drive shaft (50) rotates around an axis (52) for use in drilling into the earth.

The first hoisting means (30*a*) is parallel to and hoists the traveling frame (12) along a first hoisting axis (54*a*). The second hoisting means (30*b*) is parallel to and hoists the traveling frame (12) along a second hoisting axis (54*b*). The first hoisting axis (54*a*) and the second hoisting axis (54*b*) are contemplated to be substantially parallel to the axis (52) about which the rotating drive shaft (50) rotates.

Figure 2:
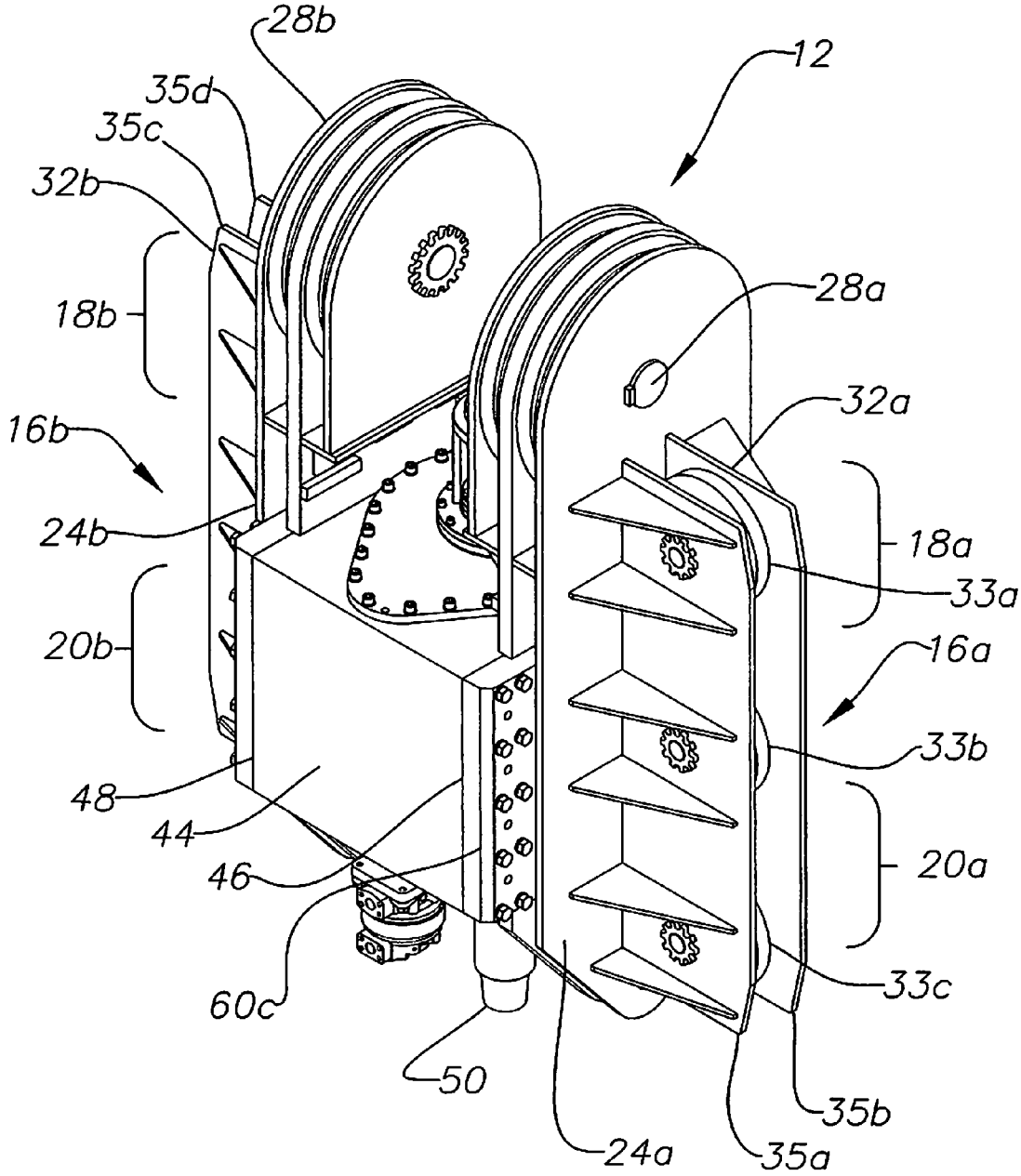
FIG. 2 is a perspective view of the shock mounted top drive of FIG. 1.

Referring now to FIG. 2, a perspective view of the shock mounted top drive of FIG. 1 is shown.

The first housing section (16*a*) has a first upper section (18*a*) and a first lower section (20*a*). The first set of sheaves (28*a*) shown mounted to the first upper housing (16*a*). The second housing section (16*b*) has a second upper section (18*b*) and a second lower section (20*b*). The second set of sheaves (28*b*) is shown mounted to the second upper housing (16*b*).

Each set of sheaves can be mounted to the upper housing sections using any type of fastener, including threaded screws and bolts, or by welding or similar means.

A first guide wheel assembly (32*a*) is shown secured to the first outboard side (26*a*) of the first housing section (16*a*). A second guide wheel assembly (32*b*, not visible in this view), is secured to the second outboard side (26*b*) of the second housing section (16*b*).

Each guide wheel assembly is depicted having three individual guide wheels, of which three guide wheels (33*a*, 33*b* and 33*c*) of the first guide wheel assembly (32*a*) are visible. However, guide wheel assemblies having more or fewer guide wheels are contemplated, depending on the height of the traveling frame (12).

Each guide wheel can be made from a polyamide, steel, or other similar materials, and can have a diameter ranging from about 3 inches to about 20 inches.

Each guide wheel assembly can also include one or more wear pads. The first guide wheel assembly (32*a*) has a first wear pad (35*a*) and a second wear pad (35*b*). The second guide wheel assembly (32*b*) has a third wear pad (35*c*) and a fourth wear pad (35*d*).

The first guide wheel assembly (32*a*) is contemplated to engage the first tubular (34*a*, depicted in FIG. 1), and the second guide wheel assembly (32*b*) is contemplated to engage the second tubular (34*b*, depicted in FIG. 1). Each guide wheel is contemplated to rotate as the traveling frame (12) moves vertically along the drilling tower.

The traveling frame (12) is contemplated to move at a rate from about 200 feet per minute to about 300 feet per minute.

The power swivel housing (44) is shown having a first traveling frame side (46) and a second traveling frame side (48). The first traveling frame side (46) is shown secured to the first inboard side (24*a*) of the first housing section (16*a*). The second traveling frame side (48) is shown secured to the second inboard side (24*b*) of the second housing section (16*b*).

The power swivel housing (44) can range from about 36 inches to about 48 inches in length, from about 26 inches to about 34 inches in width, and from about 15 inches to about 30 inches in height.

A set of removable top drive retainers (60*c*) is visible in FIG. 2, for securing the power swivel housing (44) to the first inboard side (24*a*) of the first housing section (16*a*). The removable top drive retainers (60*c*) can include a plurality of any type of fasteners, such as threaded screws, bolts, and other similar fasteners. The removable top drive retainers (60*c*) can also be secured to the traveling frame (12) by welding or other similar means.

The rotating drive shaft (50) is shown secured through the power swivel housing (44).

Figure 3:
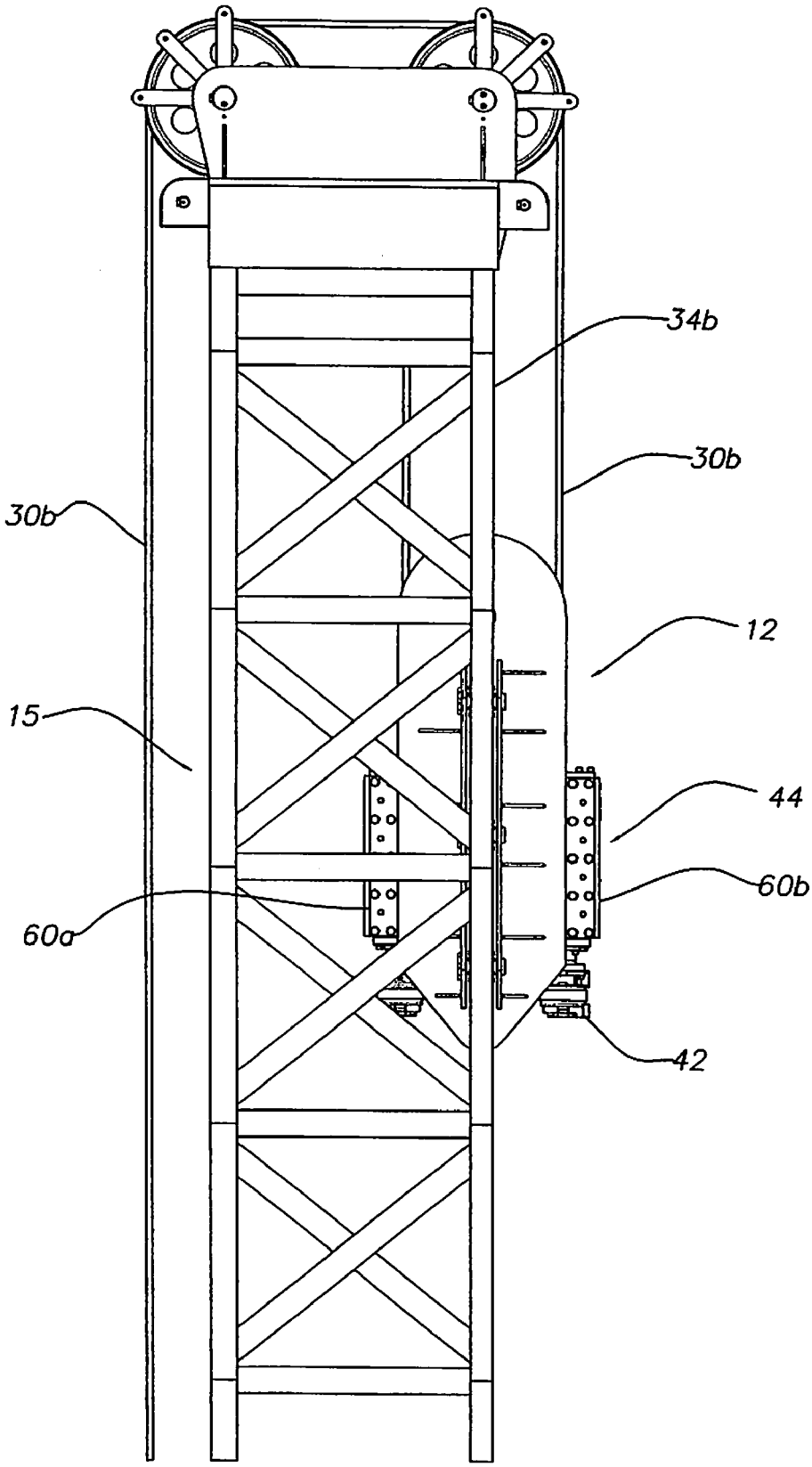
FIG. 3 is a side view of the shock mounted top drive and drilling tower of FIG. 1.

Referring now to FIG. 3, a side view of the shock mounted top drive and drilling tower of FIG. 1 is shown.

The drilling tower (15) is shown with the second tubular (34*b*) visible. The traveling frame (12) is shown secured to the second tubular (34*b*). The second hoisting means (30*b*) is visible and secured to the traveling frame (12) for maintaining and changing the vertical position of the traveling frame (12) along the drilling tower (15).

FIG. 3 depicts a traveling frame (12) having a top drive power swivel (42) secured thereon. A first set of removable top drive retainers (60*a*) and a second set of removable top drive retainers (60*b*) are shown securing the top drive power swivel (42) to the traveling frame (12).

The removable top drive retainers (60*a* and 60*b*) are depicted as solid, one-piece metal bars, such as steel bars, having ten fasteners each for securing to the traveling frame (12). Each of the removable top drive retainers extend from the top of the power swivel housing (44) to the bottom of the power swivel housing (44). The width of each removable top drive retainer can range from about 4 inches to about 12 inches.

Figure 4:
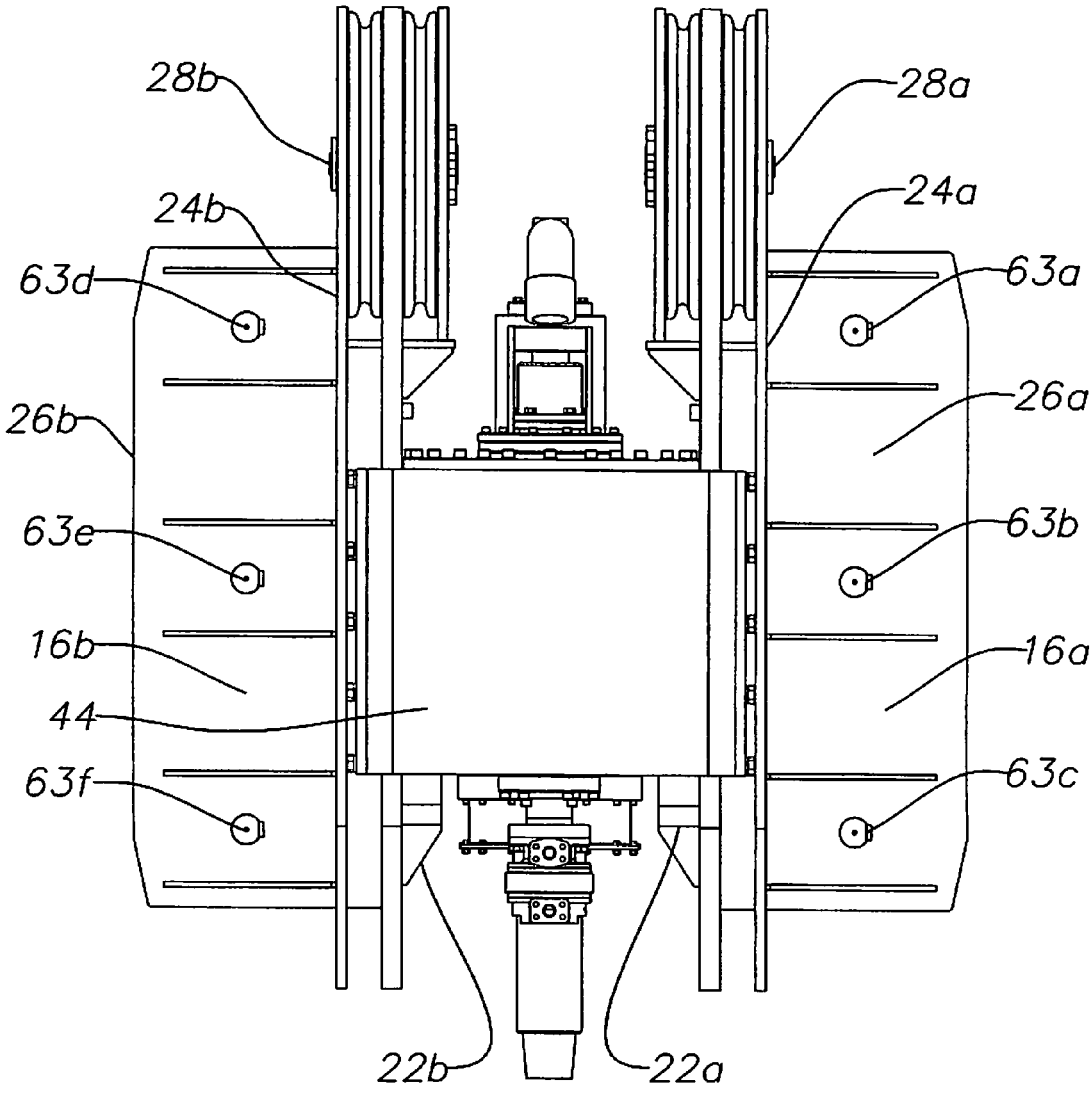
FIG. 4 is a top view of an embodiment of the present shock mounted top drive.

Referring now to FIG. 4, a top view of an embodiment of the present shock mounted top drive is shown.

A first housing section (16*a*) and a second housing section (16*b*) is shown.

A first guide wheel axis (63*a*), a second guide wheel axis (63*b*), and a third guide wheel axis (63*c*) are visible through the first housing section (16*a*), for securing individual guide wheels within the first housing section (16*a*). A fourth guide wheel axis (63*d*), a fifth guide wheel axis (63*e*), and a sixth guide wheel axis (63*f*) are visible through the second housing section (16*b*).

A power swivel housing (44) is secured to the first inboard side (24*a*) of the first housing section (16*a*) and to the second inboard side (24*b*) of the second housing section (16*b*). It is contemplated that guide wheel assemblies are secured to the first outboard side (26*a*) of the first housing section (16*a*) and to the second outboard side (26*b*) of the second housing section (16*b*).

A first set of sheaves (28*a*) is secured to the first upper section (18*a*), and a second set of sheaves (28*b*) is secured to the second upper section (18*b*), as shown in detail in FIG. 2.

A first lower section housing extension (22*a*) is secured to the first lower section (20*a*), shown in detail in FIG. 2. A second lower section housing extension (22*b*) is secured to the second lower section (20*b*), also shown in detail in FIG. 2. Each lower section housing extension is contemplated to support the shock absorber, and can range in size from about 24 inches to about 36 inches in length, from about 2 inches to about 6 inches in width, and from about 2 inches to about 4 inches in height.

Figure 5:
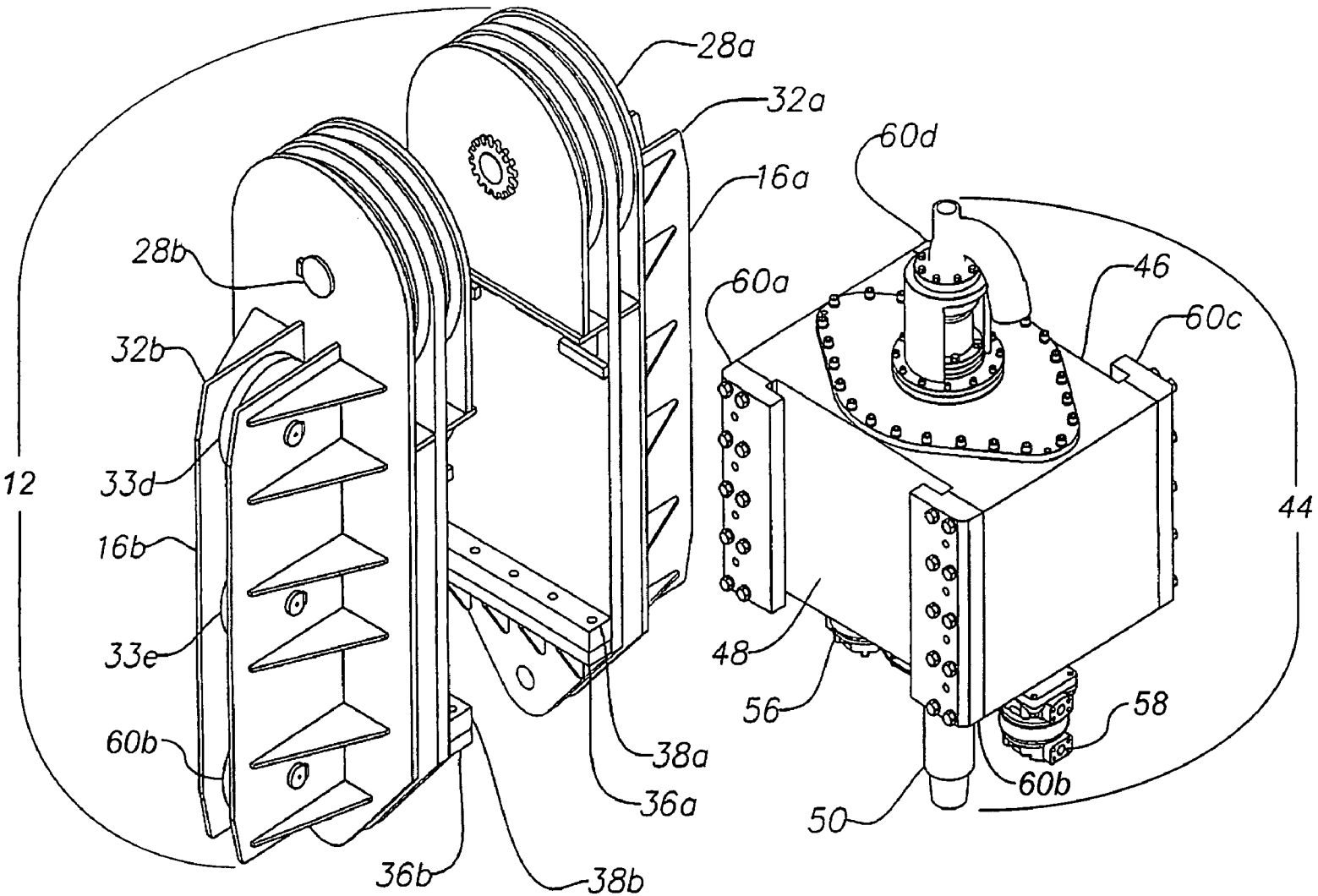
FIG. 5 is a perspective view of an embodiment of a traveling frame and a top drive power swivel with housing.

Referring now to FIG. 5, a perspective view of a traveling frame and a top drive power swivel with housing is shown.

A traveling frame (12) is shown with a first housing section (16*a*) and a second housing section (16*b*). A first guide wheel assembly (32*a*, not visible in this view) is secured to the first housing section (16*a*), and a second guide wheel assembly (32*b*) is secured to the second housing section (16*b*). Each guide wheel assembly is depicted having three individual guide wheels, of which three guide wheels (33*d*, 33*e* and 33*f*) of the second guide wheel assembly (32*b*)

A first set of sheaves (28*a*) is secured to the first housing section (16*a*), and a second set of sheaves (28*b*) is secured to the second housing section (16*b*).

A first swivel support (36*a*) is shown disposed on the inboard side of the first housing section (16*a*). A second swivel support (36*b*) is shown disposed on the inboard side of the second housing (16*b*).

Each swivel support is contemplated to support the top drive power swivel (42) when secured within the traveling frame (12). The swivel supports can be between 0.5 inches and 3 inches in thickness, can be made from coated iron, and can extend through the width of the top drive.

The first swivel support (36*a*) provides a foundation for a first shock absorber (38*a*), which is disposed on the first swivel support (36*a*). A second shock absorber (38*b*) is similarly disposed on the second swivel support (36*b*). Each shock absorber is depicted as a single homogenous layer of shock absorbing material, such as a synthetic rubber; however shock absorbers having multiple layers of differing materials are also contemplated.

A top drive power swivel (42) is shown with a housing having a first traveling frame side (46) opposite a second traveling frame side (48). A first removable top drive retainer (60*a*) and a second removable top drive retainer (60*b*) are secured to the second traveling frame side (48). A third removable top drive retainer (60*c*) and a fourth removable top drive retainer (60*d*) are secured to the first traveling frame side (46).

Each removable top drive retainer is contemplated to be useable to secure the top drive power swivel (42) within the traveling frame (12).

The top drive power swivel (42) is also depicted having a rotating drive shaft (50) extending through the top drive power swivel (42). FIG. 5 also depicts a first hydraulic motor (56) and a second hydraulic motor (58) for providing power to the top drive power swivel (42). Useable hydraulic motors can include Rineer Model 37 Hydraulic motors.

Figure 6:
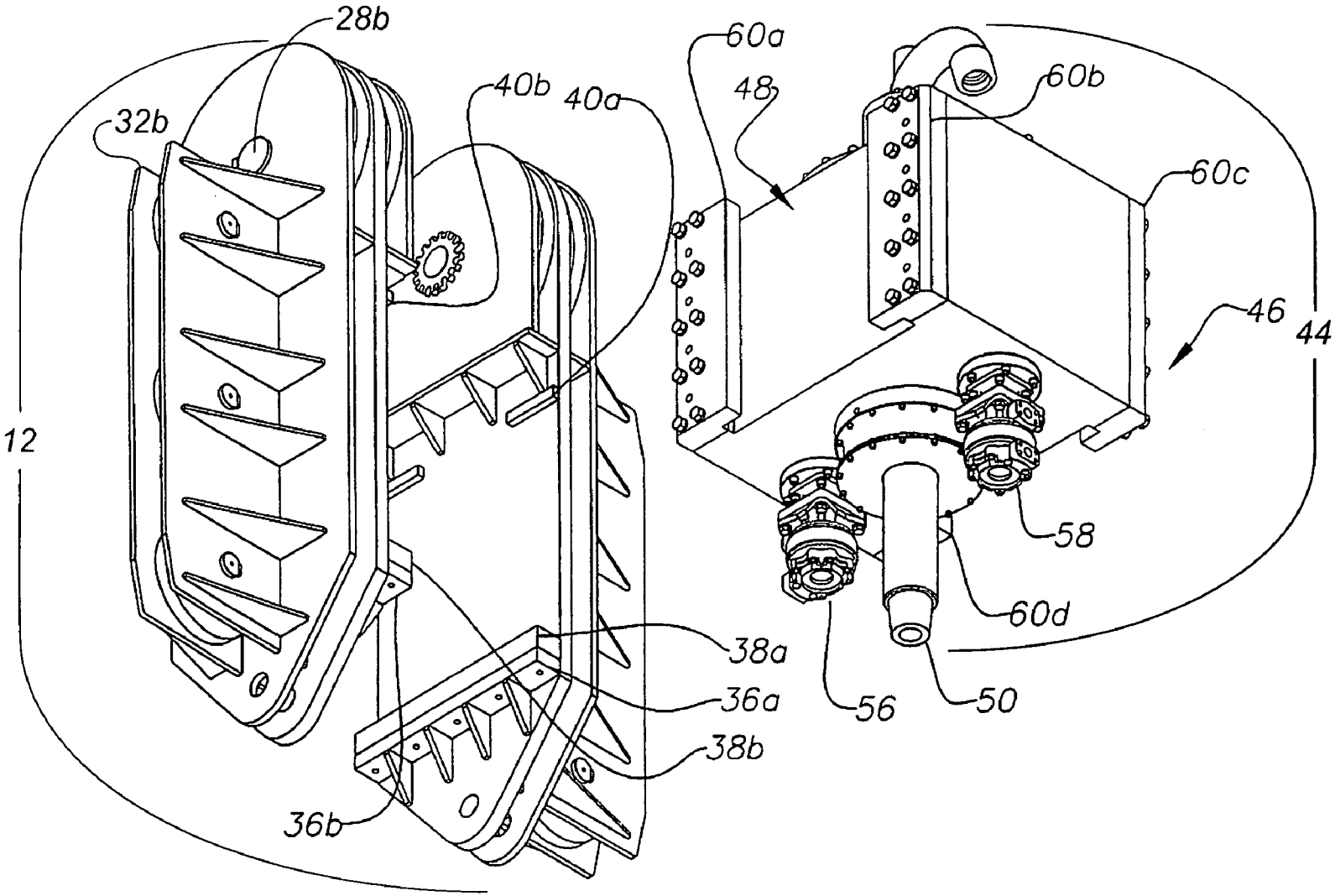
FIG. 6 is a perspective view of the underside of the traveling frame and top drive power swivel of FIG. 5.

Referring now to FIG. 6, a perspective view of the underside of the traveling frame and top drive power swivel of FIG. 5 is shown.

The traveling frame (12) is shown secured to the first set of sheaves (28*a*) and the second set of sheaves (28*b*). The traveling frame (12) is also secured to the first guide wheel assembly (32*a*, not visible in this view), and the second guide wheel assembly (32*b*).

The traveling frame also has the first swivel support (36*a*) and the second swivel support (36*b*) disposed on each inboard side of the traveling frame housing. The first shock absorber (38*a*) is shown disposed on the first swivel support (36*a*), and the second shock absorber (38*b*) is shown disposed on the second swivel support (36*b*).

FIG. 6 also depicts a first upper stop (40*a*) secured to the traveling frame (12) above the first shock absorber (38*a*). A second upper stop (40*b*) is secured to the traveling frame (12) above the second shock absorber (38*b*). Each upper stop (40*a* and 40*b*) is depicted as a stiff bar of steel, and can range in size from about 8 inches to about 12 inches in length, from about 2 inches to about 4 inches in width, and from about 2 inches to about 3 inches in thickness.

The top drive power swivel is shown having a power swivel housing (44) with a first traveling frame side (46) and a second traveling frame side (48). A rotating drive shaft (50) extends through the power swivel housing (44).

A first removable top drive retainer (60*a*) and a second removable top drive retainer (60*b*) are secured to the second top traveling frame side (48). A third removable top drive retainer (60*c*) and a fourth removable top drive retainer (60*d*) are secured to the first traveling frame side (46).

Each removable power swivel retainer (60*a*, 60*b*, 60*c* and 60*d*) is contemplated to secure to the inboard sides of the traveling frame (12) between the upper stops (40*a* and 40*b*), and the shock absorbers (38*a* and 38*b*), to control and restrict the movement of the top drive power swivel (42).

The first hydraulic motor (56) and the second hydraulic motor (58) are depicted, for providing power to the top drive power swivel (42).

While these embodiments have been described with emphasis on the embodiments, it should be understood that within the scope of the appended claims, the embodiments might be practiced other than as specifically described herein.

What is claimed is:

1. A shock mounted top drive for well drilling rigs, comprising:

a. a traveling frame for moving along a drilling tower, wherein the traveling frame comprises:

(i) a first housing section and a second housing section, wherein each housing section has an upper section, a lower section with a lower section housing extension, an inboard side, and an outboard side;

(ii) at least one set of sheaves mounted to each upper section of each housing section, wherein each set of sheaves is adapted to engage a hoisting means;

(iii) a guide wheel assembly secured to each outboard side of each housing section, wherein each guide wheel assembly is adapted to engage a tubular of the drilling tower;

(iv) at least one swivel support disposed on each inboard side of each lower section;

(v) at least one shock absorber disposed on each swivel support; and (vi) at least one upper stop connected to each inboard side of each upper section;

b. a top drive power swivel comprising a power swivel housing having a first traveling frame side opposite a second traveling frame side, a rotating drive shaft rotatable on an axis disposed through the power swivel housing, wherein the axis is parallel to a hoisting axis formed by the hoisting means, and wherein the top drive power swivel receives power from at least two hydraulic or electric motors; and c. a plurality of removable top drive retainers secured to the power swivel housing enabling the top drive power swivel to engage each housing section of the traveling frame, wherein the plurality of top drive retainers engage each inboard side of each housing section between the upper stops and the shock absorbers enabling vertical motion by the top drive power swivel between the shock absorbers and the upper stops.

2. The shock mounted top drive of claim 1, wherein the vertical motion comprises a distance of up to 12 inches between the shock absorbers and the upper stops.

3. The shock mounted top drive of claim 1, wherein the vertical motion comprises compressing of the shock absorbers by the top drive power swivel without any additional vertical motion by the traveling frame assembly.

4. The shock mounted top drive of claim 1, wherein the drilling tower is a derrick.

5. The shock mounted top drive of claim 4, wherein the traveling frame travels along tubulars which comprise the derrick.

6. The shock mounted top drive of claim 1, wherein the shock absorbers comprise a compressible material that absorbs energy.

7. The shock mounted top drive of claim 6, wherein the shock absorbers comprise a member of the group consisting of: steel alloy, rubber, synthetic rubber, an elastomer, a polyamide, or combinations thereof.

8. The shock mounted top drive of claim 1, wherein the rotating drive shaft rotates between about 0 revolutions per minute to about 180 revolutions per minute.

9. The shock mounted top drive of claim 1, wherein each guide wheel assembly comprises at least one guide wheel disposed between at least two wear pads.

10. The shock mounted top drive of claim 1, wherein the upper stops comprise a non deformable stiff metal capable of resisting deformation upon impact.

11. The shock mounted top drive of claim 10, wherein the upper stops comprise at least two metal bars in a spaced apart relation.

12. The shock mounted top drive of claim 1, wherein the swivel supports comprise steel or coated iron.

13. The shock mounted top drive of claim 12, wherein each swivel support comprises a bar extending the width of the power swivel housing having a thickness ranging from about 0.5 inches to about 3 inches.

14. The shock mounted top drive of claim 1, wherein each top drive retainer comprises a bar of stiff non-deformable generally rectangular material, having a width ranging from three and nine inches a length that generally is the length of the power swivel housing.

* * * * *